US006220237B1

(12) United States Patent
Johnson et al.

(10) Patent No.: US 6,220,237 B1
(45) Date of Patent: Apr. 24, 2001

(54) COMPRESSED AIR TOY GUN

(75) Inventors: Lonnie G. Johnson, Atlanta; John T. Applewhite, Smyrna; Jeffrey Shane Matthews, Milner, all of GA (US)

(73) Assignee: Johnson Research & Development Company, Inc., Smyrna, GA (US)

( * ) Notice: Subject to any disclaimer, the term of this patent is extended or adjusted under 35 U.S.C. 154(b) by 0 days.

(21) Appl. No.: 09/363,925

(22) Filed: Jul. 30, 1999

(51) Int. Cl.[7] ..... F41B 11/12

(52) U.S. Cl. ..... 124/73; 124/60; 124/65; 124/69; 124/75

(58) Field of Search ..... 124/56, 60, 63, 124/64, 65, 69, 71, 72, 73, 75, 76, 70, 74

(56) References Cited

U.S. PATENT DOCUMENTS

| | | | |
|---|---|---|---|
| 1,713,432 | 5/1929 | Griggs . | |
| 2,023,124 | 12/1935 | Dickover | 46/86 |
| 2,147,003 | 2/1939 | Von Kozurik | 124/11 |
| 2,312,244 | 2/1943 | Feltman | 124/11 |
| 2,357,951 | 9/1944 | Hale | 124/11 |
| 2,409,653 | 10/1946 | Andur | 124/11 |
| 2,505,428 | 4/1950 | Pope | 124/11 |
| 2,654,973 | 10/1953 | Lemelson | 46/56 |
| 2,733,699 | 2/1956 | Krinsky | 124/13 |
| 2,927,398 | 3/1960 | Kaye et al. | 46/74 |
| 3,025,633 | 3/1962 | Kaye et al. | 46/74 |
| 3,049,832 | 8/1962 | Joffe | 46/74 |
| 3,121,292 | 2/1964 | Butler et al. | 46/74 |
| 3,218,755 | 11/1965 | Quercetti | 46/86 |
| 3,308,803 | 3/1967 | Walther | 124/13 |
| 3,397,476 | 8/1968 | Weber | 43/6 |
| 3,415,010 | 12/1968 | Belz | 46/241 |
| 3,510,980 | 5/1970 | Pippin, Jr. | 46/74 |
| 3,943,656 | 3/1976 | Green | 46/74 |
| 3,962,818 | 6/1976 | Pippin | 46/74 |
| 4,004,566 | 1/1977 | Fischer | 124/11 |
| 4,073,280 | 2/1978 | Koehn | 124/72 |
| 4,083,349 | 4/1978 | Clifford | 124/72 |
| 4,159,705 | 7/1979 | Jacoby | 124/63 |
| 4,223,472 | 9/1980 | Feket et al. | 46/44 |
| 4,411,249 | 10/1983 | Fogarty et al. | 124/64 |
| 4,466,213 | 8/1984 | Alberico et al. | 446/56 |
| 4,531,503 * | 7/1985 | Shepherd | 124/76 |
| 4,674,470 * | 6/1987 | Tsukji | 124/74 |
| 4,687,455 | 8/1987 | Sculatti | 446/52 |
| 4,834,059 * | 5/1989 | Moorhouse et al. | 124/67 |
| 4,848,307 | 7/1989 | Tsao | 124/59 |
| 4,890,767 | 1/1990 | Burlison | 222/78 |
| 4,897,065 | 1/1990 | Fertig et al. | 446/63 |
| 4,928,661 | 5/1990 | Bordt et al. | 124/61 |
| 4,955,512 | 9/1990 | Sharples | 222/386.5 |
| 5,090,708 | 2/1992 | Gerlitz et al. | 273/310 |
| 5,188,557 | 2/1993 | Brown | 446/212 |
| 5,229,531 | 7/1993 | Song | 42/58 |

(List continued on next page.)

FOREIGN PATENT DOCUMENTS

2587911-A1 10/1985 (FR) .

*Primary Examiner*—Peter M. Poon
*Assistant Examiner*—James S. Bergin
(74) *Attorney, Agent, or Firm*—Baker, Donelson, Bearman & Caldwell

(57) ABSTRACT

An air compressed gun (10) is provided having a stock (11), a launch tube (12), a magazine (18) and a manual air pump (14). A loading tube (29) extends from the magazine to an opening (50) in the launch tube. A pressure chamber (15) is mounted within the launch tube in a stationary position relative to the stock. The pressure chamber has a release valve (16) therein and an annular seal (48) sized for sealing engagement with the launch tube. The launch tube is reciprocally moved between a loading position with the launch tube opening (50) positioned on one side of the pressure chamber seal (48) and a firing position with the launch tube opening (50) positioned on an opposite side of the pressure chamber seal (48).

24 Claims, 4 Drawing Sheets

U.S. PATENT DOCUMENTS

| | | | | |
|---|---|---|---|---|
| 5,280,778 | | 1/1994 | Kostiopoulos | 124/73 |
| 5,280,917 | | 1/1994 | Ortiz | 273/318 |
| 5,339,791 | | 8/1994 | Sullivan | 124/73 |
| 5,343,849 | | 9/1994 | Steer | 124/72 |
| 5,343,850 | | 9/1994 | Steer | 124/64 |
| 5,349,938 | | 9/1994 | Farrell | 124/73 |
| 5,370,278 | | 12/1994 | Raynie | 222/175 |
| 5,373,832 | | 12/1994 | D'Andrade | 124/69 |
| 5,413,514 | | 5/1995 | Milligan | 446/36 |
| 5,415,152 | | 5/1995 | Adamson et al. | 124/59 |
| 5,450,839 | | 9/1995 | Nicolaevich et al. | 124/73 |
| 5,471,968 | | 12/1995 | Lee | 124/64 |
| 5,496,025 | * | 3/1996 | Phillips | 124/56 |
| 5,497,758 | | 3/1996 | Dobbins et al. | 124/73 |
| 5,515,837 | | 5/1996 | Nin et al. | 124/59 |
| 5,529,050 | | 6/1996 | D'Andrade | 124/56 |
| 5,553,598 | | 9/1996 | Johnson et al. | 124/63 |
| 5,605,140 | | 2/1997 | Griffin | 124/59 |
| 5,613,483 | | 3/1997 | Lukas et al. | 124/73 |
| 5,673,679 | | 10/1997 | Walters | 124/53.5 |
| 5,701,879 | | 12/1997 | Johnson et al. | 124/69 |
| 5,704,342 | | 1/1998 | Gibson et al. | 124/73 |
| 5,769,066 | | 6/1998 | Schneider | 124/75 |
| 5,771,875 | | 6/1998 | Sullivan | 124/72 |
| 5,787,869 | * | 8/1998 | Johnson et al. | 124/69 |
| 5,878,734 | | 3/1999 | Johnson et al. | 124/59 |
| 5,924,413 | * | 7/1999 | Johnson et al. | 124/72 |

* cited by examiner

COMPRESSED AIR TOY GUN

TECHNICAL FIELD

This invention relates to compressed air guns, and specifically to compressed air toy guns which fire a succession of projectiles.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts or balls. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in rapid sequence. The rapid firing of a gun may be desired for those playing a mock war or other type of competition.

Today children who play mock wars often carry several guns at one time in order to fire several shots simultaneously or in rapid succession or carry a gun which is capable to firing several shots. Guns which may fire several shots in rapid succession typically include a magazine which holds the projectiles. However, the transfer of the projectiles from the magazine to the breach of the gun has been difficult to accomplish, especially wherein the projectiles are made of a soft, pliable material. The difficulty with the transfer of soft projectiles and the like has been the inherent tendency to deform under force rather than being guided by a force. As such, the projectiles often become stuck within the transfer mechanism or within the breach itself.

Accordingly, it is seen that a need remains for a toy air gun which may be fire a succession of projectiles from a magazine without the projectiles becoming lodged during the transfer between the magazine and the breach mechanism. It is to the provision of such therefore that the present invention is primarily directed.

SUMMARY OF THE INVENTION

In a preferred form of the invention a gun adapted to launch a projectile comprises an elongated launch tube having an longitudinal axis and sized and shaped to receive a projectile. The gun also has a moveable seal mounted within the interior of the launch tube sized and shaped to sealably engage a first portion of the projectile positioned within the launch tube and a stationary seal positioned within the interior of the launch tube adapted to engage a second portion of the projectile generally opposite the first portion. The stationary seal is adapted to allow reciprocal movement of the launch tube relative to the stationary seal while maintaining sealing engagement between the stationary seal and the launch tube. The launch tube, moveable seal and stationary seal define a firing chamber. The launch tube is moveable between a loading position and a firing position so as to vary the distance between the moveable seal and the stationary seal along the longitudinal axis of the launch tube to cause the moveable seal to sealably engage the projectile and capture the projectile between the moveable and stationary seals. The gun also includes means for providing a supply of compressed air to the firing chamber for launching the projectile from the launch tube. With this construction, the projectile is captured between the seals through relative movement of the moveable and stationary seals to each other which ensures sealing engagement of the projectile with the moveable seal during the transfer of compressed air into the firing chamber.

DETAILED DESCRIPTION

Figure 1:
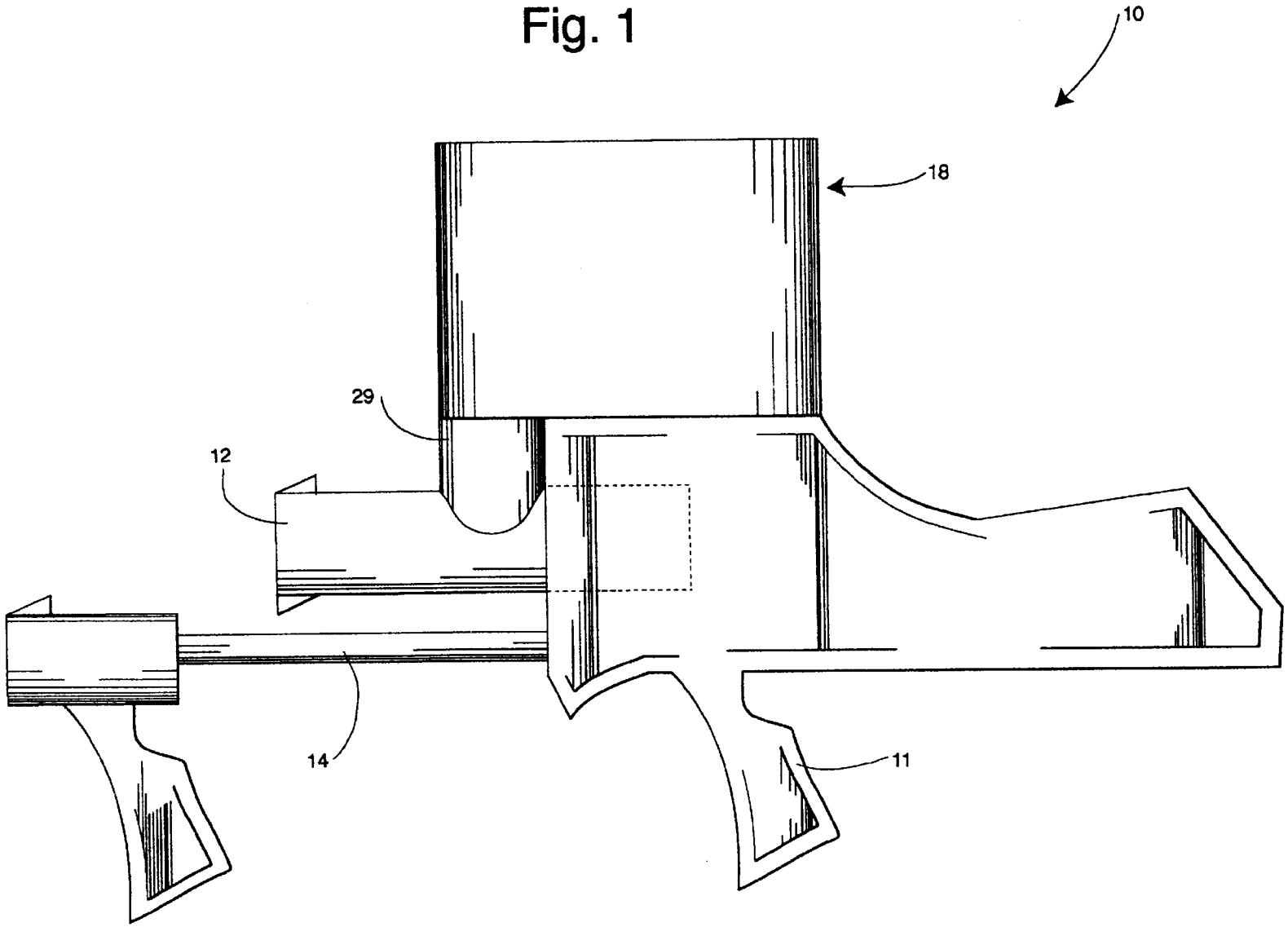
FIG. 1 is a side view of a compressed air gun embodying principles of the present invention in a preferred form.

With reference next to the drawings, there is shown a compressed air gun 10 having a stock or handle 11, a launch tube 12 reciprocally mounted to the stock 11, and a manual air pump 14. The gun 10 has a pressure chamber 15 positioned within the launch tube 12 and a release valve 16 mounted within the pressure chamber 15 in fluid communication with the air pump 14 through a pressure tube 17. The gun also includes a multi-projectile hopper or magazine 18 mounted for rotational movement upon the stock 11.

The pump 14 includes a conventional cylinder 20, a cylinder rod 21 terminating at a sealing head 19, and a handle 22 mounted to an end of the cylinder rod 21. The handle 22 has a flange 23 projecting upwardly.

Figure 5:
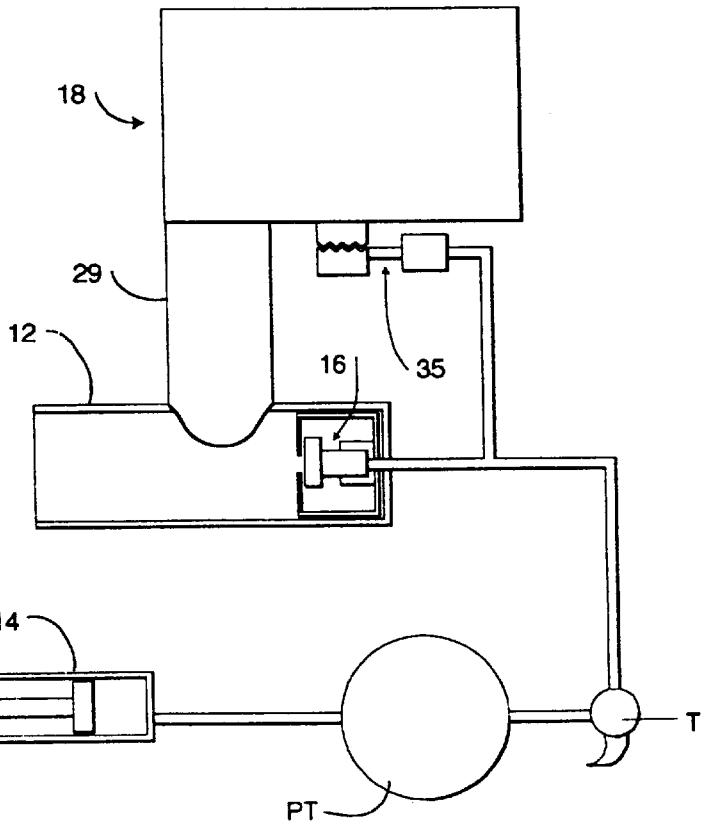
FIG. 5 is a schematic view of a compressed air gun in another preferred form of the invention.
Figure 4:
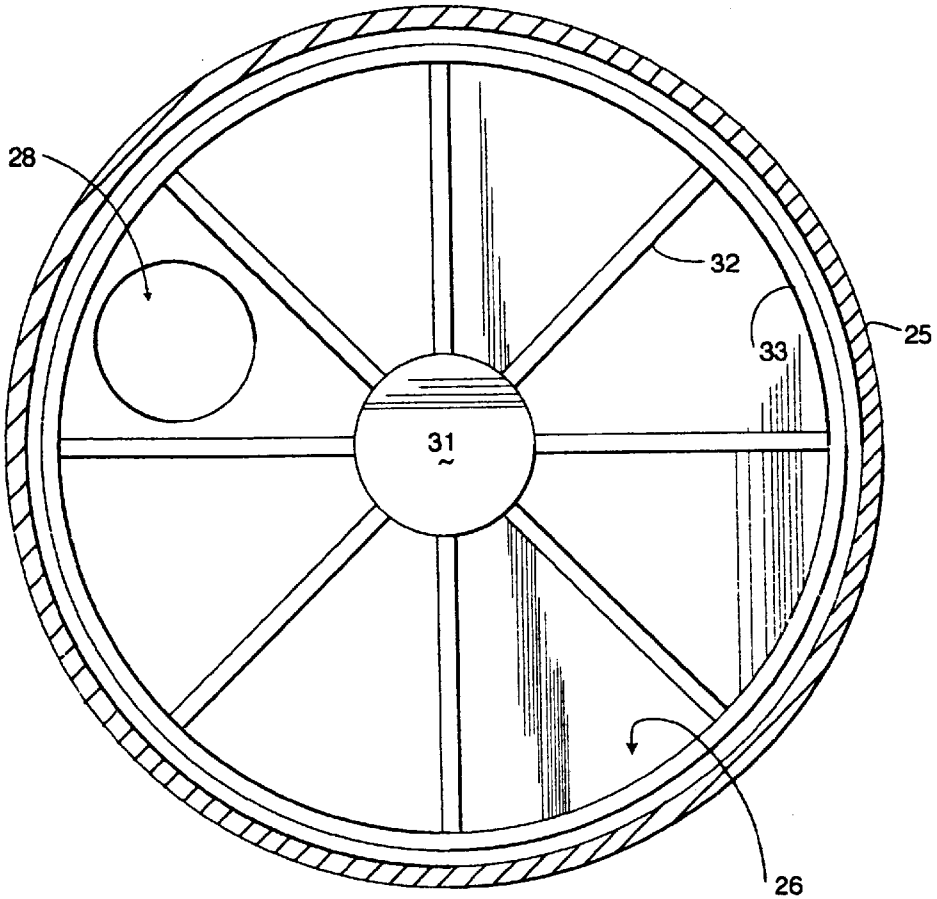
FIG. 4 is a top view of the magazine.

The magazine 18 has a cylindrical outer shell 25 and an internal indexing wheel 26 positioned within the outer shell 25, as best shown in FIG. 5. The outer shell 25 includes a pivotal lid 27 and a bottom opening 28 extending to a loading tube 29. The indexing wheel 26 has a central pivot hub 31 having an annular array of fins 32 extending therefrom which are coupled to an annular internal housing ring 33. The central hub 31 is mounted to an indexer 35 having a rachet assembly 36 and a pneumatic drive 37 coupled to pressure tube 17 through a pressure tube 38. The rachet assembly 36 has an angled toothed top plate 39 and an angled toothed bottom plate 40 sized and shaped to conform with top plate 39 and rotate relative to the bottom plate in only one direction. The bottom plate 40 is coupled to pneumatic drive 37 and a coil spring 41 which biases the bottom plate in a direction opposite to the force of the pneumatic drive 37.

The pressure chamber 15 is fixedly mounted to the stock 11 and adapted to receive and store a supply of air at elevated pressure levels. The pressure chamber 15 has an exit opening 43 therein. The release valve 16 has a cylindrical manifold 45 and a cylindrical plunger 46 slidably mounted within manifold 45 in alignment with exit opening 43. Plunger 46 has a gasket 47 to ensure sealing engagement of the plunger 46 about exit opening 43. The pressure chamber 15 also includes an annular, O-ring type seal 48 which provides an air tight seal between the pressure chamber 15 and the interior of the launch tube 12. In this embodiment the front wall of the pressure chamber may be considered part of a "seal" which seals off the launch tube.

The launch tube 12 has a top opening 50 sized and shaped to allow the passage of projectiles therethrough and a forward, annular, O-ring type seal 52 fixedly mounted to the interior of the launch tube in a location spaced forward of opening 50. The launch tube 12, pressure chamber 15 and seal 52 define a firing chamber 55. The launch tube 12 also has slots therethrough through which extend portions of the pressure chamber and pressure tube 38 to allow unobstructed reciprocal movement of the launch tube as described in more detail hereinunder. A flange 54 sized and shaped to engage pump flange 23 depends from the front end of the launch tube 12. A spring 56 extends between the launch tube and the stock so as to bias the launch tube forwardly. The launch tube 12 is adapted for reciprocal movement between a loading position shown in FIG. 2 and a firing position shown in FIG. 3.

Figure 2:
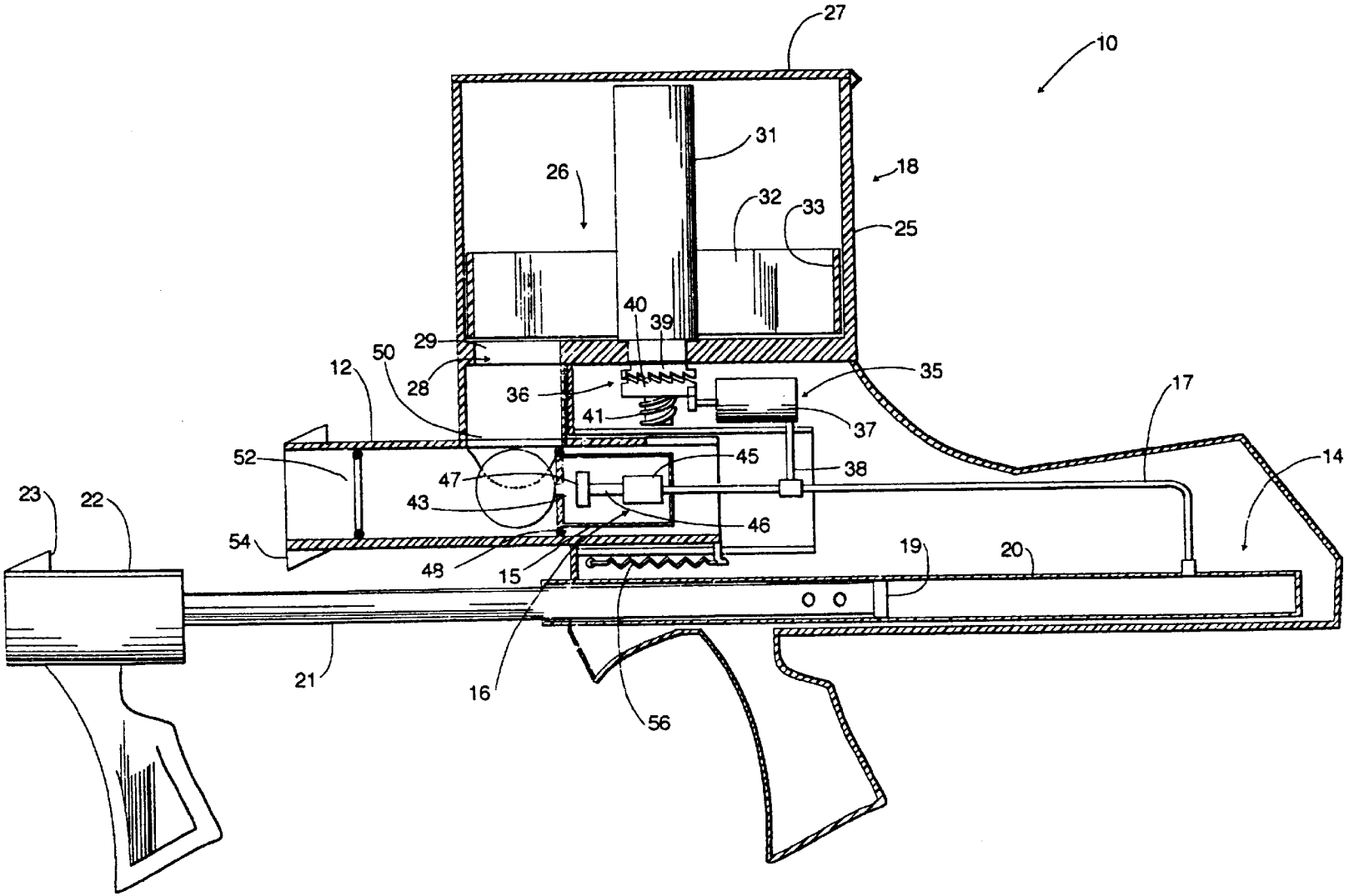
FIGS. 2 and 3 are a sequence of side views, shown in partial cross-section, showing a portion of the air gun of FIG. 1, which show in sequence, the actuation of the launch tube and pump.

In use, an operator actuates the pump to pressurize a supply of air by grasping the handle 22 and moving the cylinder rod 21 rearwardly within the cylinder 20. Pressurized air within the cylinder passes through pressure tube 17 into the manifold 45 of the release valve 16. The pressurized air within the release valve manifold 45 causes the plunger 46 to move to a forward position sealing the opening 43. Pressurized air then flows between the plunger 46 and the release valve manifold 45 so as to pressurize the pressure chamber 15. A portion of the pressurized air passing through pressure tube 17 is diverted into pressure tube 38 and conveyed into the pneumatic drive 37. With increased pressure within the pneumatic drive 37 the drive forces the rotation of the bottom plate 40, which engages and causes the rotation of the top plate 39 against the biasing force of coil spring 41. The movement of the top plate 39 in turn causes the rotation of the indexing wheel 26, thereby bringing a projectile P in alignment with the opening 28 in the bottom of the magazine 18. The projectile P drops downwardly through the opening 28, through the loading tube 29, and through the launch tube opening 50 so that the projectile P is positioned within the launch tube 12, as shown in FIG. 2. All references herein to directions are for purposes of clarity in reference to the drawings.

Figure 3:
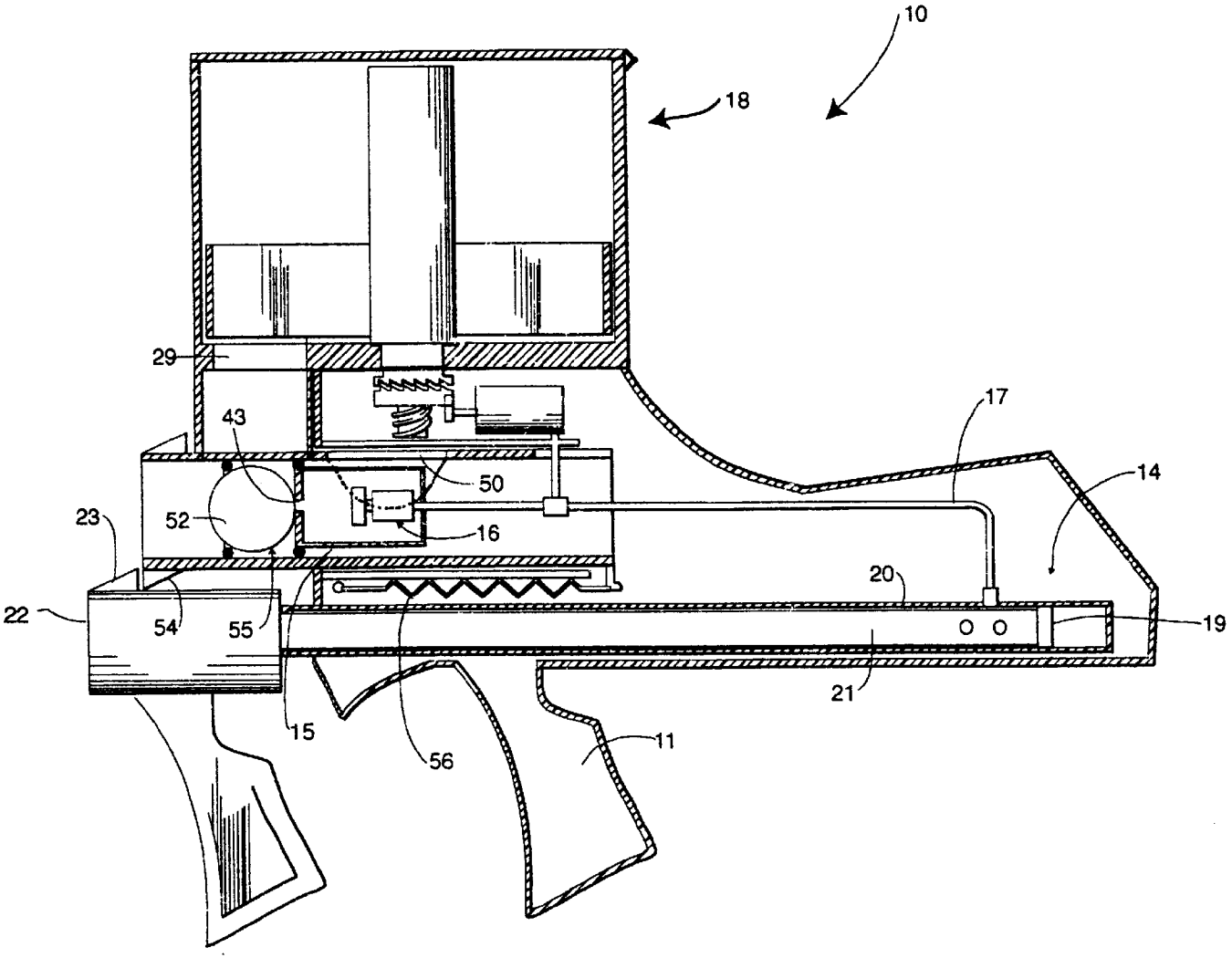

Continued movement of the pump handle 22 causes handle flange 23 to engage launch tube flange 54 and move the launch tube 12 from its loading position, shown in FIG. 2, to its firing position, shown in FIG. 3, against the biasing force of spring 56. This rearward movement of the launch tube causes the forward seal 52 is engage the projectile P. This movement also causes the launch tube opening 50 to be positioned behind the pressure chamber seal 48 so that with the projectile sealably engaging the forward seal as the firing chamber 55 is sealed completely.

The final movement of the launch tube by the movement of the pump coincides with the maximum pressure of the pump, so that the passage of the pump sealing head 19 past the pump coupled to pressure tube 17 causes a release of air pressure within pressure tube 17 back into the pump cylinder. The release of air pressure causes the pressure valve plunger 46 to move to a rearward position unsealing opening 43. With the unsealing of opening 43 pressurized air within pressure chamber 15 flows through opening 43, into the firing chamber 55 of the launch tube. Pressurized air within launch tube propels the projectile P past the forward seal 52 and from the launch tube. The actuation of this type of release valve and air pump is described in more detail in U.S. Pat. No. 5,701,879 which is specifically incorporated herein.

Upon the release of pressurized air from pressure chamber 15 the pressurized air within pneumatic drive 37 is released through pressure tubes 38 and 17. The release of air from pneumatic drive 37 causes the bottom plate 40 to be rotatably spring biased by coil spring 41 back to its initial position. As such, the bottom plate is again registered with the top plate 39 so as to initiate the next indexing movement of the magazine wheel 26.

The return of the pump handle 22 to its initial, extended position, shown in FIG. 2, allows the spring biasing force of spring 56 to return the launch tube 12 to its initial, loading position.

It should be understood that the forward seal 52 causes enough resistance to not only insure a proper seal about the projectile but to momentarily delay the forward travel of the projectile so that there is a maximum build up of compressed air within the firing chamber of the launching tube. As such, as the projectile passes the forward seal there is a maximum force of air pressure within the launch tube to provide maximum distance of the projectile.

It should be understood that a pressure tank, alone or in addition to the air pump, may also be used to provide compressed air, as shown in FIG. 5. Such an arrangement is also described in detail in U.S. Pat. No. 5,787,869 and U.S. patent application Ser. No. 08/822,008, which are specifically incorporated herein. As such, a gun may utilize a pump, a pressure tank, or the combination of a pump and pressure tank to provide a supply of compressed air.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A gun adapted to launch a projectile comprising:

an elongated launch tube sized and shaped to receive a projectile, said launch tube having a longitudinal axis;

a moveable seal fixedly mounted within the interior of said launch tube sized and shaped to sealably engage a first portion of the projectile positioned within said launch tube;

a stationary seal positioned within the interior of said launch tube adapted to engage a second portion of the projectile generally opposite the first portion, said stationary seal being adapted to allow reciprocal movement of said launch tube relative to said stationary seal while maintaining sealing engagement between said stationary seal and said launch tube;

said launch tube, said moveable seal and said stationary seal defining a firing chamber, said launch tube being moveable between a loading position and a firing position so as to vary the distance between said moveable seal and said stationary seal along the longitudinal axis of said launch tube to cause said moveable seal to sealably engage the projectile and capture the projectile between said first and stationary seals; and means for providing a supply of compressed air to said firing chamber for launching the projectile from said launch tube, whereby capturing the projectile between the seals through relative movement of said moveable and stationary seals forwards each other ensures sealing engagement of the projectile with the moveable seal during the transfer of compressed air into the firing chamber.

2. The gun of claim 1 wherein said means for providing compressed air comprises an air pump.

3. The gun of claim 2 wherein said pump engages said launch tube wherein the movement of said pump causes the movement of said launch tube from said loading position to said firing position.

4. The gun of claim 1 wherein said means for providing compressed air comprises a pressure tank.

5. The gun of claim 4 wherein said means for providing compressed air further comprises an air pump.

6. The gun of claim 1 wherein said means for providing compressed air comprises a pressure chamber mounted within said launch tube.

7. The gun of claim 6 wherein said means for providing compressed air further comprises an air pump in fluid communication with said pressure chamber.

8. The gun of claim 1 wherein said moveable seal is an annular seal.

9. The gun of claim 1 wherein said launch tube has an opening sized and shaped to allow the passage of projectiles therethrough and wherein the launch tube opening is positioned between said moveable and stationary seals with the launch tube in its loading position, and wherein said stationary seal is positionable between said launch tube opening and said moveable seal with the launch tube positioned in its firing position.

10. The gun of claim 9 further comprising a loading tube alignable with said launch tube opening with said launch tube in its loading position.

11. The gun of claim 10 further comprising a projectile magazine coupled to said loading tube for holding a plurality of projectiles.

12. The gun of claim 1 further comprising spring means for forcing said launch tube from said firing position to said loading position.

13. A gun adapted to launch a projectile comprising:

a loading tube sized and shaped to convey projectiles therethrough;

a launch tube having an opening therein alignable with said loading tube and sized and shaped to allow the passage of projectiles therethrough;

a stationary seal mounted within said launch tube for sealing engagement with said launch tube;

means for providing compressed air into said launch tube for firing the projectile; and said launch tube being adapted for reciprocal movement between a loading position with said launch tube opening aligned with an end of said loading tube and said opening positioned on one side of said stationary seal, and a firing position with said launch tube opening positioned on an opposite side of said stationary seal from said one side, whereby with the launch tube in its loading position a projectile may be passed from the loading tube into the launch tube through the launch tube opening, and whereby the launch tube may then be moved to its firing position with the launch tube opening positioned past the stationary seal so as to seal the launch tube opening from the compressed air entering the launch tube.

14. The gun of claim 13 further comprising a launch tube seal coupled to said launch tube in a position spaced from said opening.

15. The gun of claim 13 wherein said means for providing compressed air comprises an air pump.

16. The gun of claim 15 wherein said pump engages said launch tube wherein the movement of said pump causes the movement of said launch tube from said loading position to said firing position.

17. The gun of claim 13 wherein said means for providing compressed air comprises a pressure tank.

18. The gun of claim 17 wherein said means for providing compressed air further comprises an air pump.

19. The gun of claim 18 further comprising spring means for forcing said launch tube from said firing position to said loading position.

20. The gun of claim 13 wherein said means for providing compressed air comprises a pressure chamber mounted within said launch tube.

21. The gun of claim 20 wherein said means for providing compressed air further comprises an air pump coupled to said pressure chamber.

22. The gun of claim 13 wherein said launch tube seal is an annular seal.

23. The gun of claim 13 further comprising a projectile magazine coupled to said loading tube for holding a plurality of projectiles.

24. The gun of claim 13 further comprising spring means for forcing said launch tube from said firing position to said loading position.

* * * * *